US011111890B2

(12) United States Patent
Akiba et al.

(10) Patent No.: US 11,111,890 B2
(45) Date of Patent: Sep. 7, 2021

(54) FUEL SUPPLY DEVICE

(71) Applicant: DENSO CORPORATION, Kariya (JP)

(72) Inventors: Takashi Akiba, Kariya (JP); Rui Adachi, Kariya (JP); Norihiro Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 278 days.

(21) Appl. No.: 16/096,783

(22) PCT Filed: Mar. 30, 2017

(86) PCT No.: PCT/JP2017/013164
§ 371 (c)(1),
(2) Date: Oct. 26, 2018

(87) PCT Pub. No.: WO2017/187875
PCT Pub. Date: Nov. 2, 2017

(65) Prior Publication Data

US 2019/0211785 A1 Jul. 11, 2019

(30) Foreign Application Priority Data

Apr. 28, 2016 (JP) ..... JP2016-90582

(51) Int. Cl.
*F02M 37/10* (2006.01)
*F02M 37/00* (2006.01)

(52) U.S. Cl.
CPC ..... *F02M 37/10* (2013.01); *F02M 37/00* (2013.01); *F02M 37/0011* (2013.01); *F02M 37/106* (2013.01)

(58) Field of Classification Search
CPC .... F02M 37/10; F02M 37/00; F02M 37/0011; F02M 37/103; F02M 37/106; F02M 37/14; G01F 23/30–23/76; F16K 31/18–31/34
See application file for complete search history.

(56) References Cited

U.S. PATENT DOCUMENTS 5,168,891 A * 12/1992 Green ..... B60K 15/077 137/114
6,216,908 B1 4/2001 Hutter et al.
(Continued)

FOREIGN PATENT DOCUMENTS

JP 2-144654 12/1990
JP 2012-184760 9/2012

*Primary Examiner* — Bryan M Lettman
*Assistant Examiner* — Dnyanesh G Kasture
(74) *Attorney, Agent, or Firm* — Nixon & Vanderhye P.C.

(57) ABSTRACT

A fuel supply device includes a surface level detection device that detects a surface level of fuel through use of a float. A supply main body is placed in a fuel tank through an insertion opening and supplies the fuel to an outside. A surface level detection unit, which includes the float, is rotatable relative to the supply main body, and a rotational range of the surface level detection unit is set to include at least an inserting direction of the supply main body. A distal end part of the surface level detection unit, which is furthermost from an imaginary rotational center axis in the surface level detection unit, is placed on an upper side of an imaginary plane, which includes the imaginary rotational center axis and a center of gravity of the surface level detection unit, in a rotational direction of the surface level detection unit.

6 Claims, 13 Drawing Sheets

(56) References Cited

U.S. PATENT DOCUMENTS

| | | | | |
|---|---|---|---|---|
| 6,230,690 | B1 * | 5/2001 | Umetsu | B60K 15/077 123/509 |
| 9,677,926 | B2 * | 6/2017 | Terada | G01F 23/32 |
| 2005/0045458 | A1 * | 3/2005 | Daly | H01H 36/02 200/190 |
| 2005/0247128 | A1 * | 11/2005 | Fukuhara | G01F 23/38 73/313 |
| 2006/0065247 | A1 * | 3/2006 | Leymarie | F02M 37/106 123/509 |
| 2017/0341510 | A1 * | 11/2017 | Kono | F02M 37/0076 |

* cited by examiner

FUEL SUPPLY DEVICE

CROSS REFERENCE TO RELATED APPLICATION

This application is the U.S. national phase of International Application No. PCT/JP2017/013164 filed on Mar. 30, 2017 which designated the U.S. and is based on and incorporates herein by reference Japanese Patent Application No. 2016-90582 filed on Apr. 28, 2016.

TECHNICAL FIELD

The disclosure of the present description relates to a fuel supply device that is placed in an inside of a fuel tank and supplies fuel of the fuel tank to an internal combustion engine.

BACKGROUND ART

Previously, for example, the patent literature 1 discloses a fuel supply device that includes a sender gauge, which senses a level of a surface of the fuel through use of a float. The sender gauge includes: a main body, which is fixed to a pump unit of the fuel supply device; and a surface level detection unit, which has a gauge arm and the float that are rotatable relative to the pump unit. The pump unit and the sender gauge of the fuel supply device are inserted into the fuel tank through an insertion opening and is thereby placed in the inside of the fuel tank.

In general, the main body of the sender gauge includes a stopper that limits displacement of the surface level detection unit, which is configured to be rotatable, so that the stopper limits a rotational range of the surface level detection unit. In addition, as in the case of the patent literature 1, the rotational range of the surface level detection unit is set to include an inserting direction of the pump unit. Therefore, at the inserting operation for inserting the pump unit and the like into the fuel tank, the float, which is attached to a distal end side of the surface level detection unit, may contact a bottom wall surface of the fuel tank and receive a reaction force from the bottom wall surface.

The float of the patent literature 1 is shaped such that a portion of the float, which is located at a lower side in the rotational direction, has a larger volume in comparison to another portion of the float, which is located at an upper side in the rotational direction, so that the float can receive buoyancy from the fuel and thereby follow the surface level of the fuel even at a location that is adjacent to the bottom wall surface even in a case where the remaining amount of the fuel in the fuel tank is small. Therefore, at the inserting operation, when the float interferes with the bottom wall surface, the surface level detection unit is rotated toward the lower side by a force, which is applied from the bottom wall surface to the float, so that the surface level detection unit is strongly urged against the stopper that limits the displacement of the surface level detection unit toward the lower side. As a result, there is a possibility of damaging, for example, the surface level detection unit and the stopper.

CITATION LIST

Patent Literature

PATENT LITERATURE 1: JP2012-184760A

SUMMARY OF INVENTION

The present disclosure is made in view of the above disadvantage, and it is an objective of the present disclosure to provide a fuel supply device that can avoid a damage of, for example, a surface level detection unit and a stopper before a time of using the fuel supply device.

In order to achieve the above objective, according to a first aspect disclosed herein, there is implemented a fuel supply device provided with: a supply main body, which is configured to be inserted through an insertion opening of a fuel tank while the supply main body is oriented such that a specific inserting direction of the supply main body is directed toward the insertion opening; and a surface level detection device that is configured to detect a level of a surface of fuel through use of a float, which is configured to float on the fuel, the fuel supply device comprising:

the supply main body that includes a lower limit stopper, which limits displacement of the float toward a lower side, wherein the supply main body is configured to be placed in an inside of the fuel tank and supply the fuel to an outside of the fuel tank; and a surface level detection unit that includes the float and is rotatable relative to the supply main body, wherein rotation of the surface level detection unit toward the lower side is limited through contact of the surface level detection unit to the lower limit stopper, and a rotational range of the surface level detection unit is defined to include at least a space located on a side of the supply main body in the inserting direction, wherein:

a distal end part of the surface level detection unit, which is furthermost from an imaginary rotational center axis of the surface level detection unit, is located on an upper side of an imaginary plane, which includes the imaginary rotational center axis and a center of gravity of the surface level detection unit, in a rotational direction of the surface level detection unit.

According to the above-described aspect, at the time of inserting operation for inserting the supply main body of the fuel supply device into the inside of the fuel tank, the surface level detection unit is held in an orientation, in which the center of gravity of the surface level detection unit is placed below the imaginary rotational center axis in a gravitational direction by placing a portion of the surface level detection unit in the inserting direction of the supply main body. At this time, the distal end part of the surface level detection unit, which is furthermost from the imaginary rotational center axis in the surface level detection unit, is placed on the upper side of the imaginary plane, which includes the imaginary rotational center axis and the center of gravity, in the rotational direction of the surface level detection unit. Thus, even in a case where the distal end part interferes with the bottom wall surface of the fuel tank at the inserting operation, the surface level detection unit can be rotated toward the upper side by the force, which is applied from the bottom wall surface to the surface level detection unit. When the rotation of the surface level detection unit toward the lower side is limited in the above described manner, it is possible to avoid the incidence where the surface level detection unit is strongly urged against the lower limit stopper by the force, which is applied from the bottom wall surface to the surface level detection unit. Thus, the damage of, for example, the surface level detection unit and the stopper before the time of using the fuel supply device is avoided.

BRIEF DESCRIPTION OF DRAWINGS

The present disclosure, together with additional objectives, features and advantages thereof, will be best understood from the following description in view of the accompanying drawings.

DESCRIPTION OF EMBODIMENTS

Hereinafter, various embodiments of the present disclosure will be described with reference to the drawings. In the following respective embodiments, corresponding structural elements are indicated by the same reference signs and may not be redundantly described in some cases. In a case where only a part of a structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly explained as long as there is no problem. It should be understood that the unexplained combinations of the structural components recited in the following embodiments and modifications thereof are assumed to be disclosed in this description by the following explanation.

First Embodiment

Figure 1:
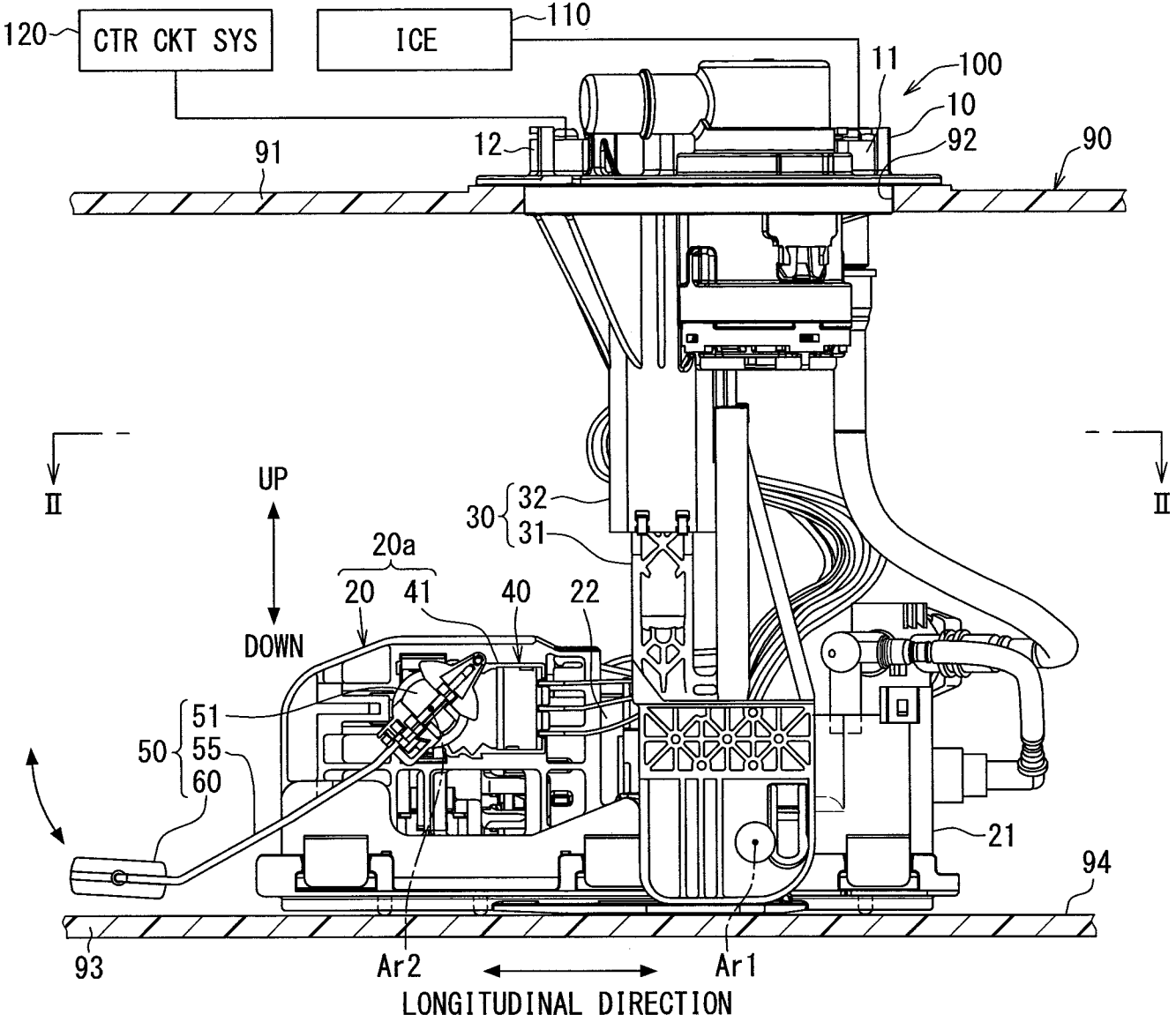
FIG. 1 is a diagram showing a state where a fuel supply device of a first embodiment is placed at a fuel tank.

A fuel supply device 100 of a first embodiment shown in FIG. 1 is placed in an inside of a fuel tank 90. The fuel tank 90 is made of a resin material or a metal material and is in a form of a hollow body. The fuel tank 90 is installed to a vehicle along with an internal combustion engine 110 and stores liquid fuel, such as gasoline or light oil, which is consumed by the internal combustion engine 110. An insertion opening 92, which is shaped into a circular form, is formed at a ceiling wall 91 of the fuel tank 90. A portion of a structure of the fuel supply device 100 is inserted into an inside of the fuel tank 90 through the insertion opening 92. An up-and-down direction of the structure placed in the inside of the fuel tank 90 substantially coincides to a vertical direction of the vehicle that is parked on a horizontal plane.

Figure 2:
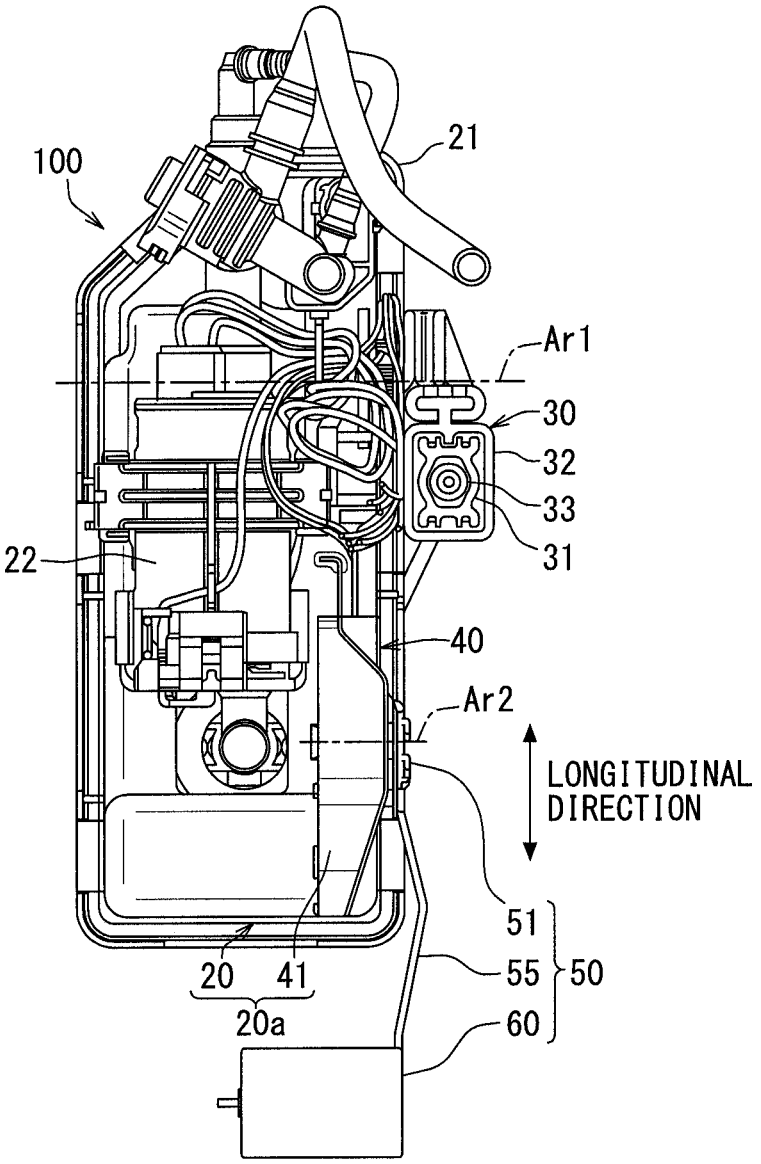
FIG. 2 is a cross-sectional view taken along line II-II in FIG. 1.

As shown in FIGS. 1 and 2, the fuel supply device 100 includes a flange 10, a sub-tank 20, a support stay 30 and a surface level detection device 40.

The flange 10 is made of a resin material and is shaped into a circular plate form as a whole. The flange 10 is installed to the ceiling wall 91 of the fuel tank 90 and thereby closes the insertion opening 92. A fuel supply pipe 11 and a connector 12 are formed at the flange 10. The fuel supply pipe 11 forms a fuel path that conducts the fuel, which is supplied from the sub-tank 20, toward the internal combustion engine 110. A plug, which is electrically connected to a control circuit system 120, is fitted to the connector 12.

The sub-tank 20 is received in the inside of the fuel tank 90 and is placed on a lower side of the flange 10. The sub-tank 20 is in an elongated form as a whole. The sub-tank 20 is urged against the bottom wall surface 94 while the sub-tank 20 is held in an installation orientation thereof, in which a longitudinal direction of the sub-tank 20 extends along an inner surface (hereinafter referred to as a bottom wall surface) 94 of a bottom wall 93 of the fuel tank 90. The sub-tank 20 includes a sub-tank main body 21 and a fuel pump 22.

The sub-tank main body 21 is shaped into a flat rectangular parallelepiped form as a whole. The sub-tank main body 21 is placed on the bottom wall surface 94 of the fuel tank 90. The fuel, which is stored in the fuel tank 90, flows into an inside of the sub-tank main body 21. The sub-tank main body 21 temporarily stores the fuel to be suctioned into the fuel pump 22.

The fuel pump 22 is an electric pump, such as an impeller pump or a trochoid pump. The fuel pump 22 is shaped into a cylindrical form as a whole. The fuel pump 22 is fixed to the sub-tank main body 21 in a state where an axial direction of the fuel pump 22 coincides with the longitudinal direction of the sub-tank 20. The fuel pump 22 is connected to the connector 12 through a flexible wiring that is flexible. A control signal is supplied from a control circuit system 120 to the fuel pump 22 through the connector 12. A suctioning operation of the fuel pump 22 for suctioning the fuel stored in the sub-tank main body 21 is controlled by the control circuit system 120. The fuel pump 22 supplies the fuel, which is suctioned at the inside of the fuel tank 90, to the internal combustion engine 110 that is placed at the outside of the fuel tank 90.

The support stay 30 is received in the inside of the fuel tank 90. The support stay 30 solely couples between the flange 10 and the sub-tank 20. The support stay 30 rotatably supports the sub-tank 20. The support stay 30 includes a lower stay portion 31, an upper stay portion 32 and a resilient member 33.

The lower stay portion 31 and the upper stay portion 32 are made of a resin material. The lower stay portion 31 is installed to the sub-tank main body 21. The lower stay portion 31 is rotatable about an imaginary main body rotational axis Ar1 relative to the sub-tank main body 21. With the above-described construction of the lower stay portion 31, the support stay 30 supports the sub-tank 20 such that the sub-tank 20 is rotatable about the main body rotational axis Ar1. The main body rotational axis Ar1 is displaced from a longitudinal center of the sub-tank 20 toward one side. In a case where the sub-tank 20 is held in the installation orientation, the main body rotational axis Ar1 extends along the bottom wall surface 94. The upper stay portion 32 is shaped into a tubular form that downwardly extends from the flange 10. The lower stay portion 31 is slidably fitted into the upper stay portion 32 from the lower side.

The resilient member 33 is a coil spring that is made of a metal material. The resilient member 33 is placed in a state where the resilient member 33 is compressed between the lower stay portion 31 and the upper stay portion 32. The resilient member 33 downwardly exerts a downward restoring force against the lower stay portion 31. With the above-described structure, when the flange 10 is securely installed to the ceiling wall 91, the sub-tank 20 is urged against the bottom wall 93. Furthermore, a relative position between the lower stay portion 31 and the upper stay portion 32 can be varied in response to expansion and contraction of the fuel tank 90.

Figure 3:
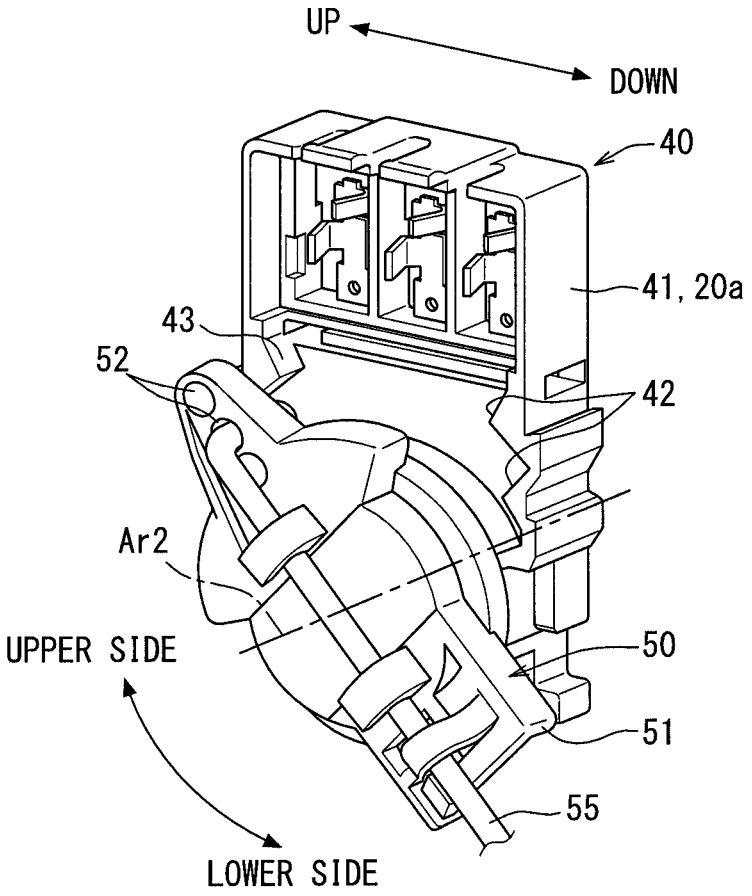
FIG. 3 is a perspective view of a surface level detection device.

The surface level detection device 40, which is shown in FIGS. 1 to 3, is received in the inside of the fuel tank 90 along with the sub-tank 20. The surface level detection device 40 detects a surface level of the fuel stored in the fuel tank 90 through use of a float 60 that floats on the fuel. The surface level detection device 40 includes a sender body 41 and a surface level detection unit 50.

The sender body 41 is made of a resin material. The sender body 41 is installed to the sub-tank main body 21 and is thereby fixed to the sub-tank 20. The sender body 41 and the sub-tank 20 form a supply main body 20*a* that rotatably supports the surface level detection unit 50. A Hall IC is received in the sender body 41. The Hall IC is a sensor that senses a rotational phase of the surface level detection unit 50. The sender body 41 includes a plurality of pairs of upper limit stoppers 42 and lower limit stoppers 43. The upper limit stoppers 42 and the lower limit stoppers 43 are opposed to each other in the up-and-down direction.

The surface level detection unit 50 is rotatable about an imaginary rotational center axis Ar2 relative to the supply main body 20*a*. The imaginary rotational center axis Ar2 is set to orient such that the imaginary rotational center axis Ar2 extends along the main body rotational axis Ar1. Therefore, in a case where the supply main body 20*a* (the sub-tank 20) is in the installation orientation, the imaginary rotational center axis Ar2 extends along the bottom wall surface 94. In addition, the rotational center axis Ar2 is located on an upper side of the main body rotational axis Ar1 of the supply main body 20*a*. Furthermore, the imaginary rotational center axis Ar2 is located on an opposite side of the longitudinal center of the supply main body 20*a*, which is opposite from the main body rotational axis Ar1 in the longitudinal direction.

The surface level detection unit 50 includes a magnet holder 51, a sender arm 55 and a float 60.

The magnet holder 51 is made of a resin material and is shaped into a circular plate form as a whole. A pair of magnets is received in the magnet holder 51. The pair of magnets is placed on two opposite sides, respectively, of the Hall IC and provides a magnetic field to the Hall IC. A plurality of stopper holes 52 is formed at the magnet holder 51.

The sender arm 55 is made of a metal material and is in a form of a cylindrical rod. One end part of the sender arm 55 is bent relative to a main body portion of the sender arm 55. The sender arm 55 is installed to the magnet holder 51 in a state where the one end part of the sender arm 55 is inserted into a corresponding one of the stopper holes 52. The one end part of the sender arm 55, which is inserted into the corresponding stopper hole 52, is contactable with the upper limit stopper 42 and the lower limit stopper 43 through rotation of the surface level detection unit 50.

The float 60 is made of a material, such as foamed ebonite, and is shaped into a flat rectangular parallelepiped form as a whole. Each side edge of the float 60 is rounded in a form of an arc that has a radius of a minute size (few millimeters). The float 60 is installed to the other end part of the sender arm 55. The float 60 can float on the surface of the fuel and is displaceable in the up-and-down direction by following a change in the surface level of the fuel while sliding in the longitudinal direction along the surface of the fuel. When the float 60 is displaced in the up-and-down direction, the surface level detection unit 50 is rotated relative to the supply main body 20*a*.

In the surface level detection unit 50 described above, when the float 60 is displaced toward the upper side in response to the rise of the surface level of the fuel, the one end part of the sender arm 55 contacts the upper limit stopper 42. Thereby, the displacement of the float 60 toward the upper side and the rotation of the surface level detection unit 50 toward the upper side are limited. As a result, contacting of the float 60 to the ceiling wall 91 is limited.

Furthermore, when the float 60 is displaced toward the lower side in response to the drop of the surface level of the fuel, the end part of the sender arm 55 contacts the lower limit stopper 43. Thereby, the displacement of the float 60 toward the lower side and the rotation of the surface level detection unit 50 toward the lower side are limited. As a result, contacting of the float 60 to the bottom wall 93 is limited.

The surface level detection device 40 detects the rotational phase of the surface level detection unit 50, which is rotated by the displacement of the float 60 through use of the Hall IC. The Hall IC is electrically connected to an in-vehicle device, such as a combination meter, which is located at the outside of the fuel tank 90. A detection result of the Hall IC is supplied to the combination meter, so that information, which indicates the remaining amount of the fuel, is provided to, for example, a driver of the vehicle.

In the fuel supply device 100, as discussed above, the sub-tank 20 and the surface level detection device 40 are inserted into the inside of the fuel tank 90 through the insertion opening 92. A structure and a function, which limit a damage of the surface level detection device 40 at the time of performing the above-described inserting operation, as well as an assembling process, which include the inserting operation, will be described below with reference to FIGS. 4 to 10. FIGS. 4 to 10 indicate a case where the sub-tank 20 and the surface level detection device 40 are inserted into the insertion opening 92 while the longitudinal direction of the supply main body 20*a* coincides with the up-and-down direction, as a worst state where the float 60 is most likely to interfere with the bottom wall surface 94.

Here, an inserting direction ID, which will be referred in the following description, is a direction that is defined with respect to the supply main body 20*a*. More specifically, the inserting direction ID is defined as a direction from the main body rotational axis Ar1 toward the imaginary rotational center axis Ar2 in the longitudinal direction of the supply main body 20*a*. The terms "upper side" and "lower side", which are used in the above discussion, are relative directions that are defined with respect to the supply main body 20*a*. Therefore, the terms "upper side" and "lower side" will be also used in the following discussion in distinction from the up-and-down direction, which is the absolute direction. In addition, the upper side and the lower side of the supply main body 20*a* in the installed state are taken as the reference to the rotational direction of the surface level detection unit. Specifically, even when the orientation of supply main body 20*a* is changed to any orientation at the time of inserting operation, a side toward the ceiling wall 91 in the installed state is the upper side, and a side toward the bottom wall 93 is the lower side. Specifically, in FIGS. 4 to 10, which indicate a view taken from the front side of the surface level detection device 40, the left side of the imaginary rotational center axis Ar2 is the upper side, and the right side of the imaginary rotational center axis Ar2 is the lower side.

Figure 4:
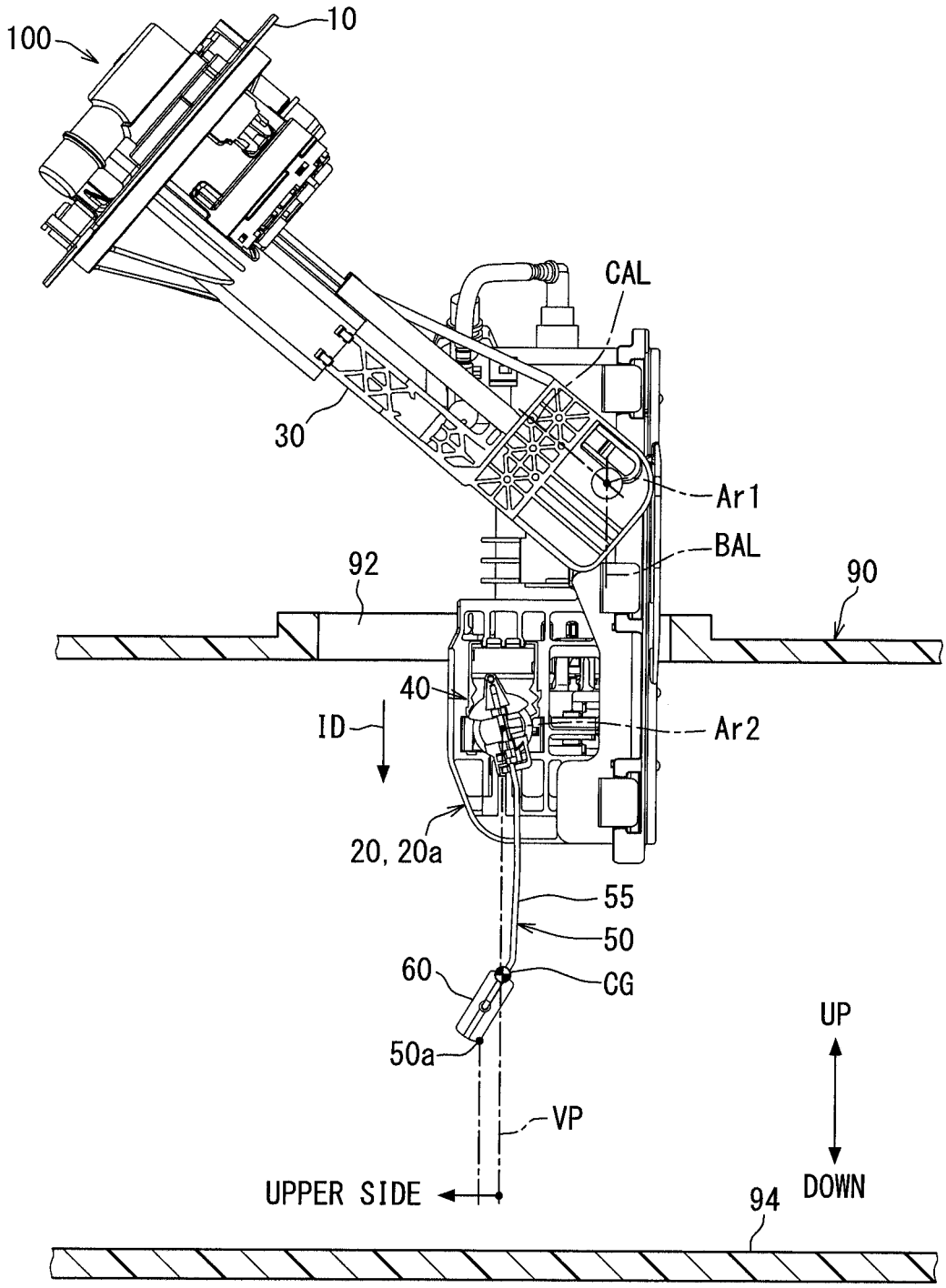
FIG. 4 is a diagram showing a process of assembling a fuel supply device in the fuel tank.

As shown in FIG. 4, a form (hereinafter referred to as an insertion form) of the fuel supply device 100 at a start time of the inserting operation differs from a form (hereinafter referred to as an installation form, see FIG. 1) of the fuel supply device 100 in the installed state of the fuel supply device 100 in the fuel tank 90.

Specifically, the support stay 30 in the insertion form is in a state where the support stay 30 is most extended in the axial direction by the restoring force of the resilient member 33 (see FIG. 2). In addition, a relative orientation of the supply main body 20*a* relative to the support stay 30 differs between the insertion form and the installation form. The supply main body 20*a*, which is in the insertion form, is held in an insertion orientation where a support portion of the surface level detection unit 50 is rotated toward the lower side relative to the support stay 30 from a state of the installation form. Specifically, in an imaginary perpendicular plane, which is perpendicular to the main body rotational axis Ar1, an imaginary line, which extends in an extending direction of the support stay 30 and intersects the main body rotational axis Ar1, is defined as a support stay axis CAL. Furthermore, in the above-described perpendicular plane, an imaginary line, which extends in the longitudinal direction of the supply main body 20*a* and intersects the main body rotational axis Ar1, is defined as a main body axis BAL. In the above-described perpendicular plane, an angle, which is defined between the support stay axis CAL and the main body axis BAL, is substantially 90 degrees in the case where the supply main body 20*a* is in the installation orientation. In contrast, in the case where the supply main body 20*a* is in the insertion orientation, the angle, which is defined between the support stay axis CAL and the main body axis BAL is enlarged to an obtuse angle (e.g., about 130 degrees), which is equal to or larger than 90 degrees.

Furthermore, a rotational range of the surface level detection unit 50 is set to include at least a space in the inserting direction ID of the supply main body 20*a*. At the time of the inserting operation, the supply main body 20*a* is inserted through the insertion opening 92 while the supply main body 20*a* is oriented such that the specific inserting direction ID is directed toward the insertion opening 92. At this time, the support stay 30, the flange 10 and the supply main body 20*a* are gripped by a worker. In contrast, the surface level detection unit 50 is not fixed to the supply main body 20*a* and is not gripped by the worker, so that the surface level detection unit 50 is inserted into the insertion opening 92 in a state where the surface level detection unit 50 is freely rotatable relative to the supply main body 20*a*. Therefore, the surface level detection unit 50 passes through the insertion opening 92 in a state where the surface level detection unit 50 is hanging down from the supply main body 20*a* by the action of gravity. Specifically, the surface level detection unit 50 is inserted into the insertion opening 92 while the surface level detection unit 50 is placed at a rotational phase, at which a center of gravity CG of the surface level detection unit 50 is positioned below (directly below) the imaginary rotational center axis Ar2 in the gravitational direction, in the rotational range of the surface level detection unit 50.

In the above-described state, the distal end part 50*a*, which is furthermost from the imaginary rotational center axis Ar2 in the surface level detection unit 50, becomes the most advanced part among the supply main body 20*a* and the surface level detection unit 50 in the inserting direction ID. In the first embodiment, one side of the float 60, which is furthermost from the imaginary rotational center axis Ar2 among four sides of the float 60 that extend along the imaginary rotational center axis Ar2, forms the distal end part 50*a*. The distal end part 50*a* makes initial contact with the bottom wall surface 94 (see FIG. 5). At this time, in a case where the surface level detection unit 50 is rotated toward the lower side by the force that is applied from the bottom wall surface 94 to the distal end part 50*a*, the one end part of the sender arm 55 is strongly urged against the lower limit stopper 43 (see FIG. 3). Thereby, damage may be generated at each corresponding part of the surface level detection device 40.

In order to avoid this kind of damage, the distal end part 50*a* of the surface level detection unit 50 is placed on the upper side of the imaginary plane VP, which includes the imaginary rotational center axis Ar2 and the center of gravity CG, in the rotational direction of the surface level detection unit 50. At the inserting operation, the imaginary plane VP becomes substantially parallel to the up-and-down direction by the gravitational force that is applied to the surface level detection unit 50. Therefore, at the inserting operation, the surface level detection unit 50, which is rotatable relative to the supply main body 20*a*, is placed such that the distal end part 50*a* of the surface level detection unit 50 is placed on the upper side of the imaginary rotational center axis Ar2.

Figure 5:
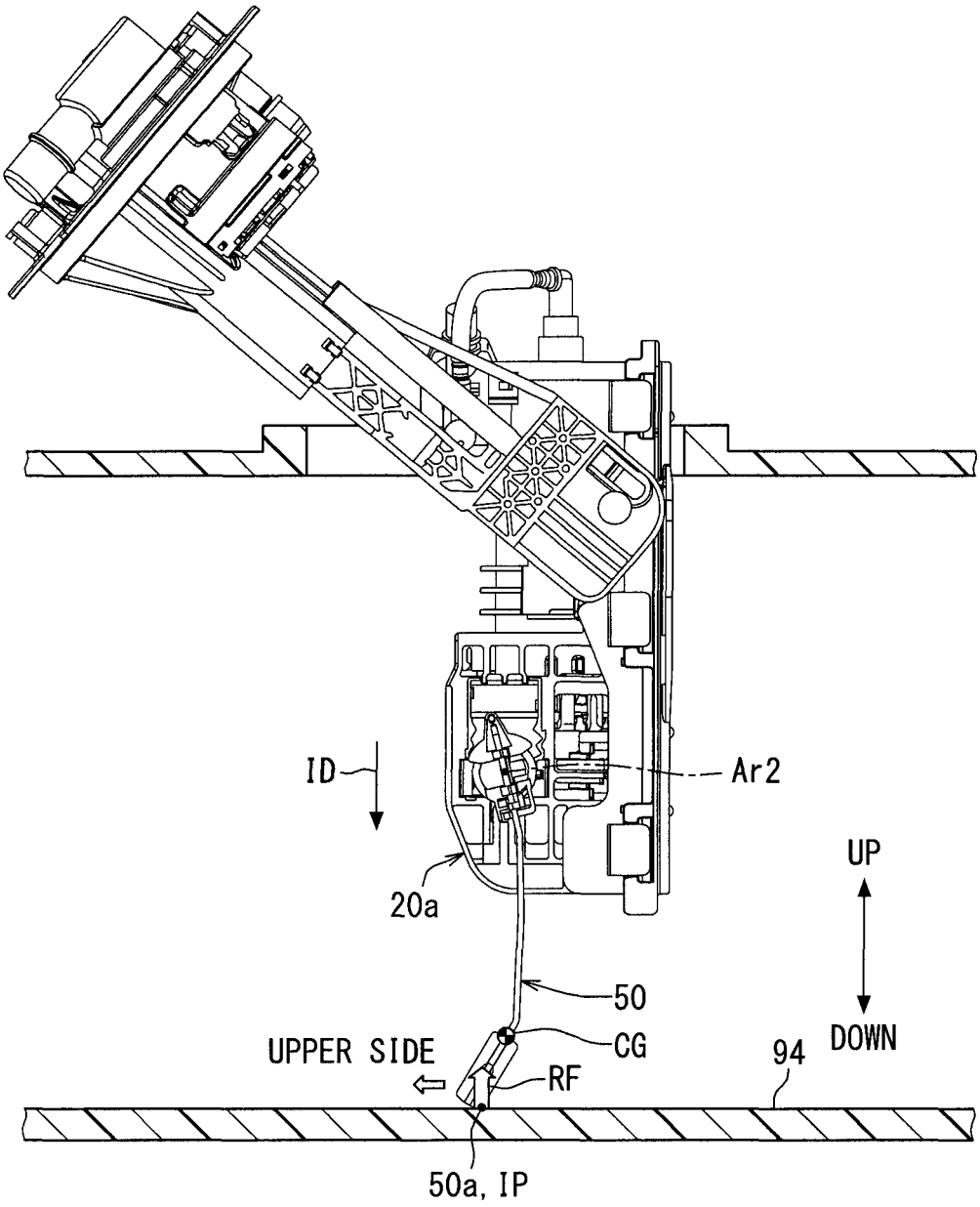
FIG. 5 is a diagram showing the process of assembling the fuel supply device in the fuel tank.

As shown in FIG. 5, the distal end part 50*a*, which is moved in the inserting direction ID by continuing the inserting operation of the supply main body 20*a* and the surface level detection unit 50, interferes with the bottom wall surface 94. At this time, a contact part IP between the distal end part 50*a* and the bottom wall surface 94 is placed on the upper side of the imaginary rotational center axis Ar2. Therefore, a reaction force RF, which is applied from the bottom wall surface 94 to the distal end part 50*a* at the contact part IP, acts as a force that rotates the surface level detection unit 50 toward the upper side.

Figure 6:
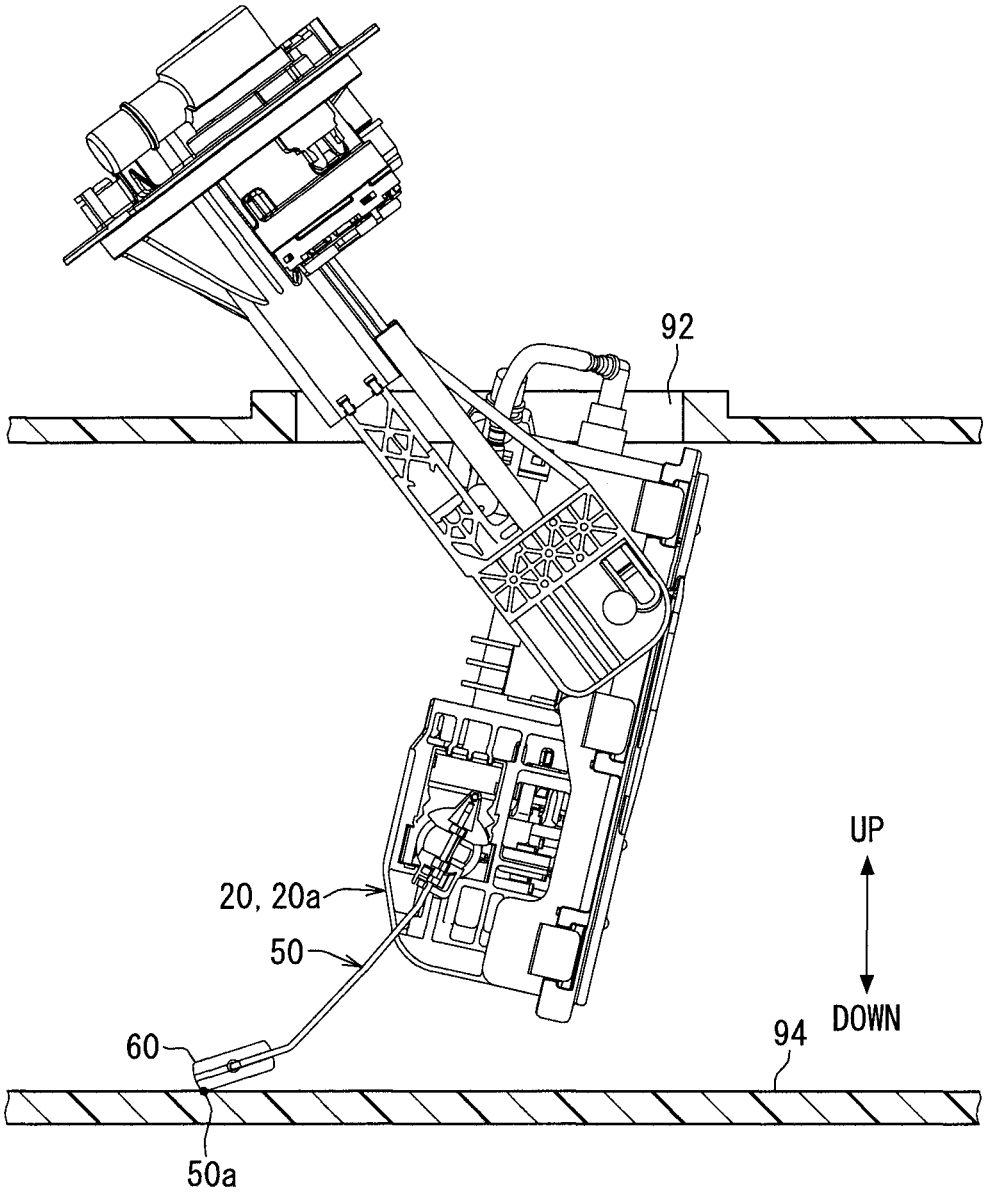
FIG. 6 is a diagram showing the process of assembling the fuel supply device in the fuel tank.

Thereby, even when the inserting operation continues in the state where the orientation of the supply main body 20*a* is kept generally in the vertical state, the surface level detection unit 50 is rotated toward a full level indicating side, at which the surface level detection unit 50 indicates the fuel tank is full of the fuel, by sliding the rounded distal end part 50*a* toward the upper side along the bottom wall surface 94, as shown in FIG. 6. Therefore, the supply main body 20*a* can pass through the insertion opening 92 while the float 60 is withdrawn from the location between the sub-tank 20 and the bottom wall surface 94.

Figure 7:
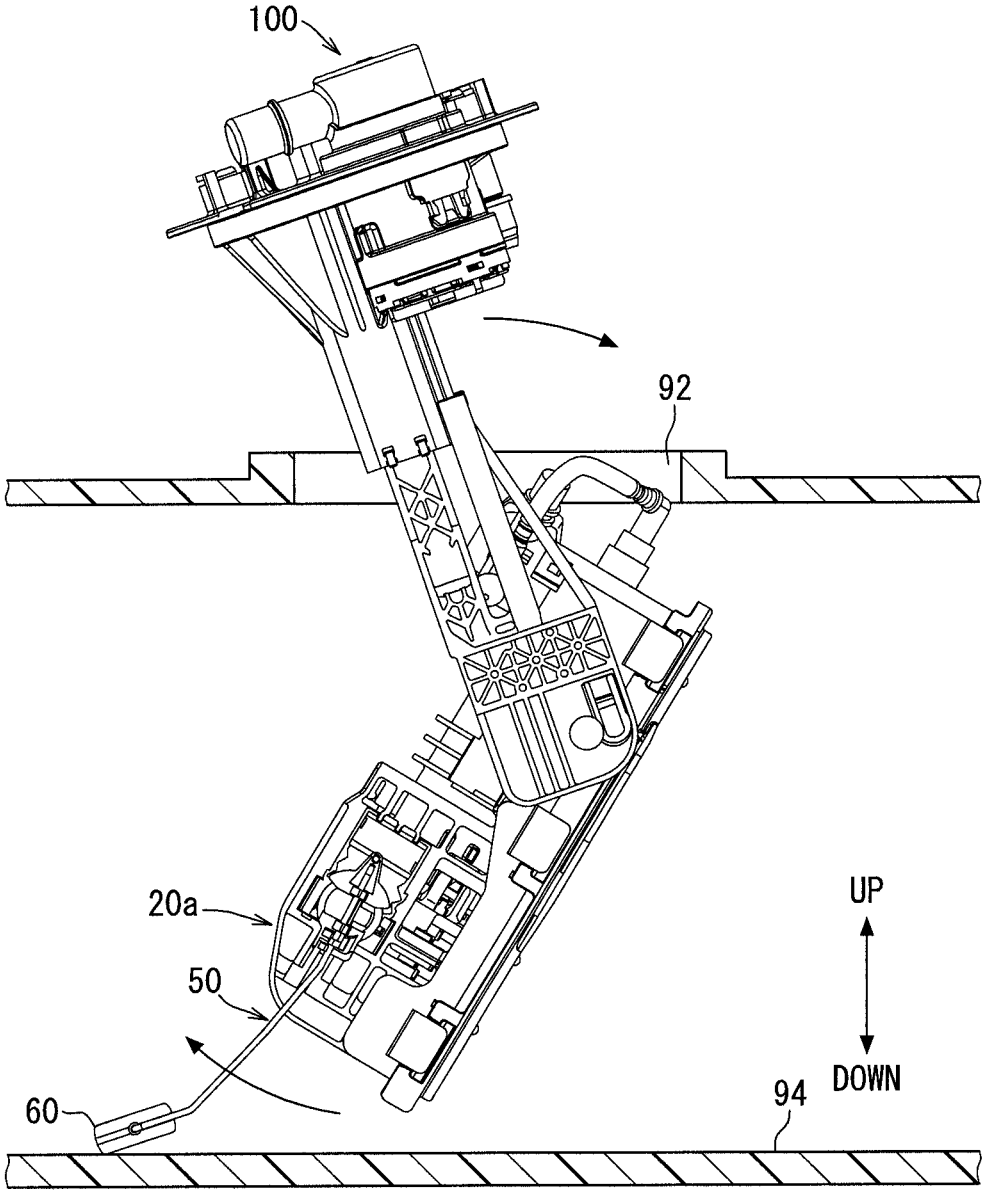
FIG. 7 is a diagram showing the process of assembling the fuel supply device in the fuel tank.

As shown in FIG. 7, when the supply main body 20*a* passes through the insertion opening 92, the worker rotates the entire fuel supply device 100. With this step, the supply main body 20*a* is progressively rotated from the orientation, in which the longitudinal direction of the supply main body 20*a* coincides with the up-and-down direction, to the orientation, in which the supply main body 20*a* is placed along the bottom wall surface 94. Thereby, the reaction force RF (see FIG. 5), which is applied from the bottom wall surface 94 to the float 60, is progressively diminished, so that the surface level detection unit 50 starts the rotation toward the lower side by the action of the gravitational force. The rotation of the surface level detection unit 50 toward the lower side is executed within a predetermined rotational range. Therefore, a load, which wound cause generation of the damage, is not applied to the surface level detection unit 50.

Figure 8:
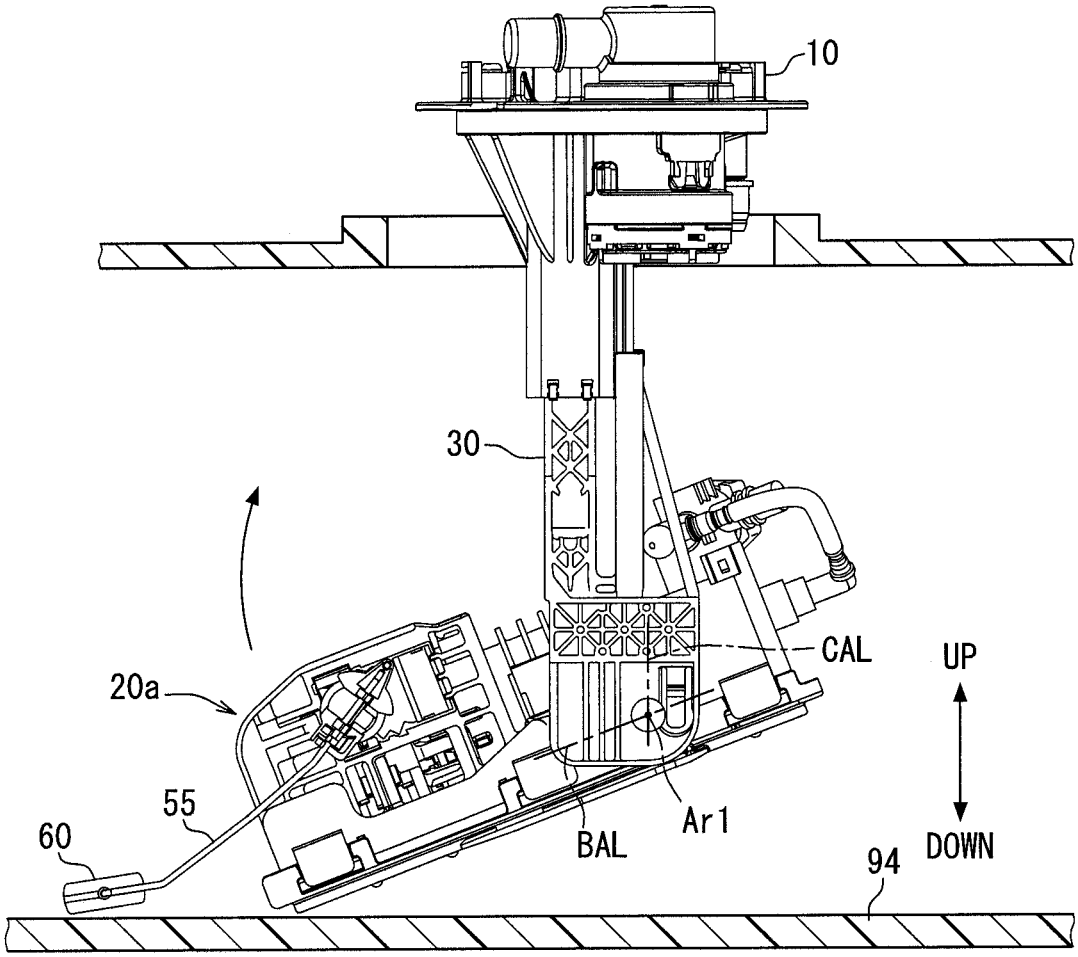
FIG. 8 is a diagram showing the process of assembling the fuel supply device in the fuel tank.

As shown in FIG. 8, when the supply main body 20*a* reaches the bottom wall surface 94, the reaction force from the bottom wall surface 94 is applied to the supply main body 20*a*. Therefore, the supply main body 20*a* is rotated about the main body rotational axis Ar1 toward the upper side relative to the support stay 30 through the inserting operation of the worker, which pushes the flange 10 in the inserting direction ID. Accordingly, the angle, which is defined between the support stay axis CAL and the main body axis BAL, is progressively changed from the obtuse angle, which is the angle implemented in the insertion form of the fuel supply device 100, to 90 degrees. Therefore, the one end part of the sender arm 55 and the lower limit stopper 43 (see FIG. 3) contact with each other, and thereby the float 60 is lifted away from the bottom wall surface 94.

Figure 9:
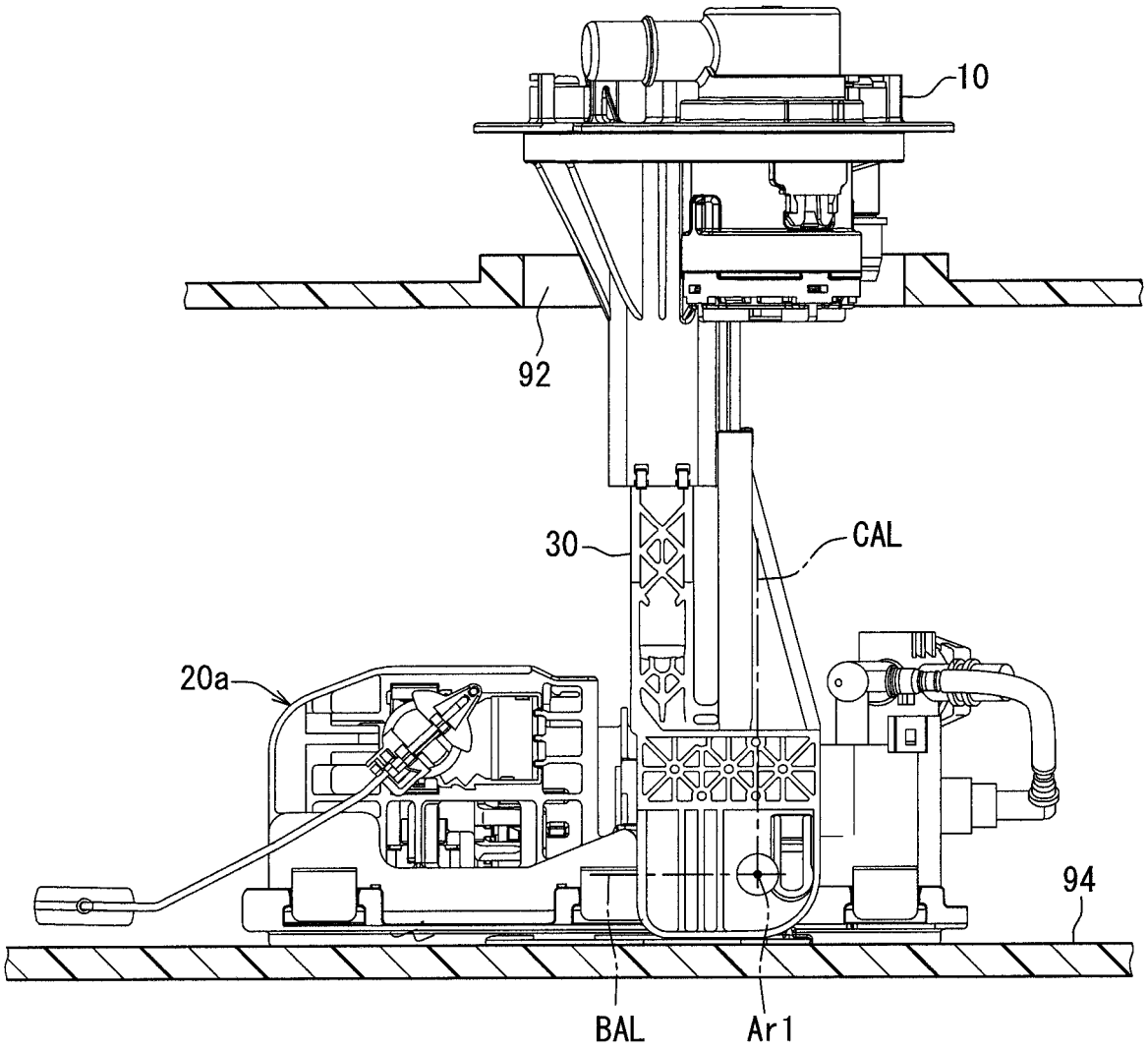
FIG. 9 is a diagram showing the process of assembling the fuel supply device in the fuel tank.
Figure 10:
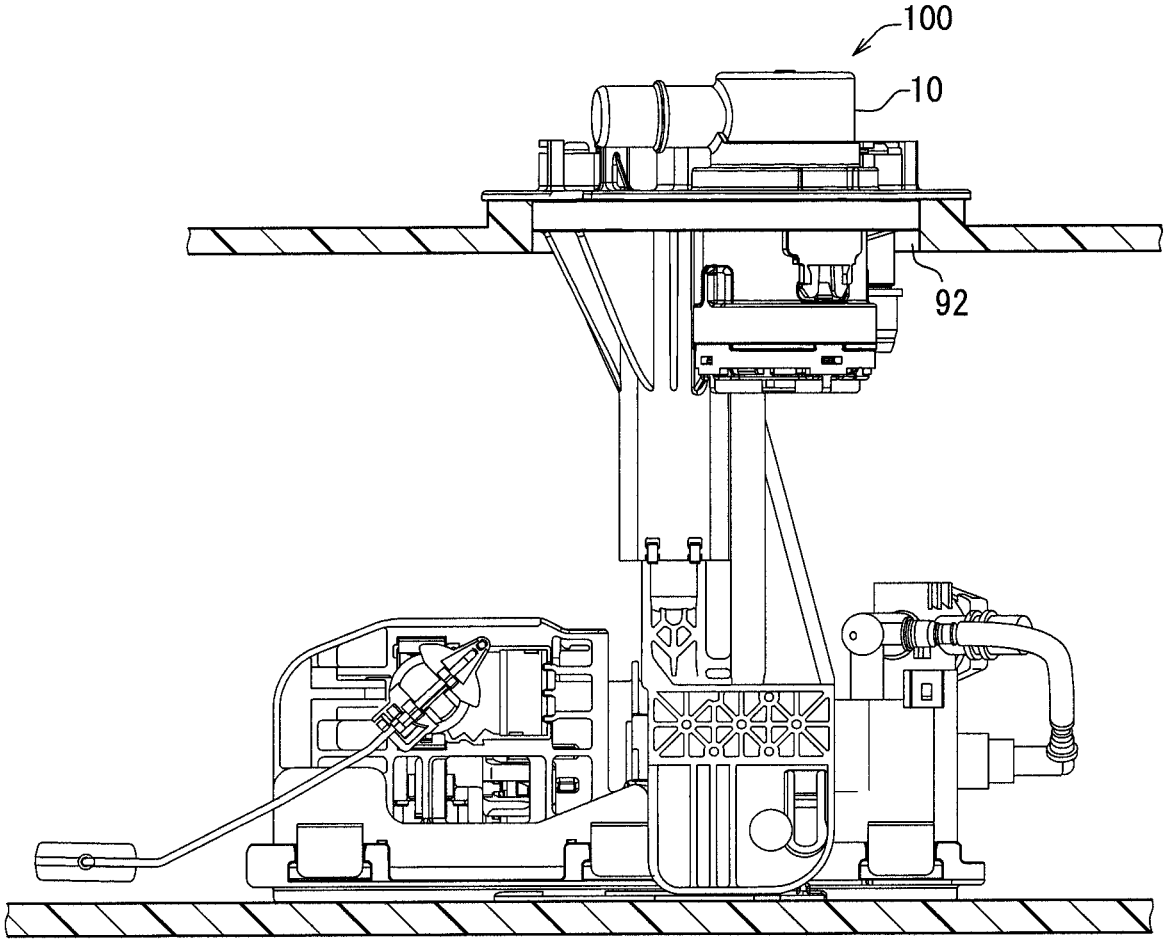
FIG. 10 is a diagram showing the process of assembling the fuel supply device in the fuel tank.

As shown in FIG. 9, a bottom wall surface of the supply main body 20*a* is seated against the bottom wall surface 94 through the relative rotation of the supply main body 20*a* relative to the support stay 30. At this time, the angle, which is defined between the support stay axis CAL and the main body axis BAL about the main body rotational axis Ar1, becomes substantially 90 degrees. Therefore, the supply main body 20*a* is held in the installation orientation that is implemented by rotating the supply main body 20*a* relative to the support stay 30 toward the upper side from the insertion orientation of the supply main body 20*a*, which enables insertion of the supply main body 20*a* through the insertion opening 92. The worker urges the flange 10 toward the insertion opening 92 against the restoring force of the resilient member 33 (see FIG. 2). Therefore, as shown in FIG. 10, the insertion opening 92 is closed with the flange 10. Thereby, the assembling process of the fuel supply device 100 is completed.

In the surface level detection unit 50 of the first embodiment discussed above, the distal end part 50*a* is placed on the upper side of the imaginary plane VP, which includes the imaginary rotational center axis Ar2 and the center of gravity CG. Therefore, even when the distal end part 50*a* contacts the bottom wall surface 94 through the inserting operation, the contact part IP between the bottom wall surface 94 and the distal end part 50*a* is placed on the upper side of the imaginary rotational center axis Ar2 (see FIG. 5). Thus, the surface level detection unit 50 can be rotated toward the upper side by the force, which is applied from the bottom wall surface 94 to the float 60.

As discussed above, when the rotation of the surface level detection unit 50 toward the lower side is limited in the above described manner, it is possible to avoid the incidence where the surface level detection unit 50 is strongly urged against the lower limit stopper 43 by the force, which is applied from the bottom wall surface 94 to the float 60. Thus, it is possible to avoid the damage of, for example, the surface level detection unit 50 and the lower limit stopper 43 before the time of using the fuel supply device 100.

In addition, the fuel supply device 100 of the first embodiment is configured such that the supply main body 20*a* is rotatable relative to the support stay 30. The supply main body 20*a* is inserted into the insertion opening 92 while the supply main body 20*a* is oriented such that the supply main body 20*a* is rotated relative to the support stay 30 toward the lower side in comparison to the installation orientation of the supply main body 20*a* in the installed state of thereof. In the fuel supply device 100 configured in this way, the rotational range of the surface level detection unit 50 is defined in the space located in the inserting direction ID of the supply main body 20*a* in order to enable the insertion of the supply main body 20*a* into the insertion opening 92 that has the limited opening area. Therefore, the above structure, which avoids the damage by limiting the rotation of the surface level detection unit 50 toward the lower side, is particularly effective for the fuel supply device 100, in which the supply main body 20*a* is rotatable relative to the support stay 30.

Furthermore, in the first embodiment, the imaginary rotational center axis Ar2 of the surface level detection unit 50 is located on the upper side of the main body rotational axis Ar1 of the supply main body 20*a*. Therefore, when the supply main body 20*a* is rotated relative to the support stay 30 toward the upper side, the float 60 is most quickly lifted and is moved away from the bottom wall surface 94 (see FIG. 5). Thereby, the damage of the surface level detection device 40 at the inserting operation is further less likely to occur.

Additionally, in the first embodiment, the imaginary rotational center axis Ar2 is placed in parallel with the main body rotational axis Ar1. Therefore, at the time of starting the inserting operation, when the longitudinal direction of the supply main body 20*a* is placed to coincide with the axial direction of the insertion opening 92, the imaginary rotational center axis Ar2 is oriented such that the imaginary rotational center axis Ar2 extends in the horizontal direction (see FIG. 4). Accordingly, the surface level detection unit 50 can be smoothly rotated relative to the supply main body 20*a* at the start time of the inserting operation, so that the center of gravity CG can be reliably positioned below the imaginary rotational center axis Ar2 in the gravitational direction. As a result, when the float 60 interferes with the bottom wall surface 94, the contact part IP between the distal end part 50*a* and the bottom wall surface 94 can be reliably placed on the upper side of the imaginary rotational center axis Ar2. Thereby, the advantage of avoiding the damage by rotating the surface level detection unit 50 toward the upper side can be stably implemented.

Second Embodiment

Figure 11:
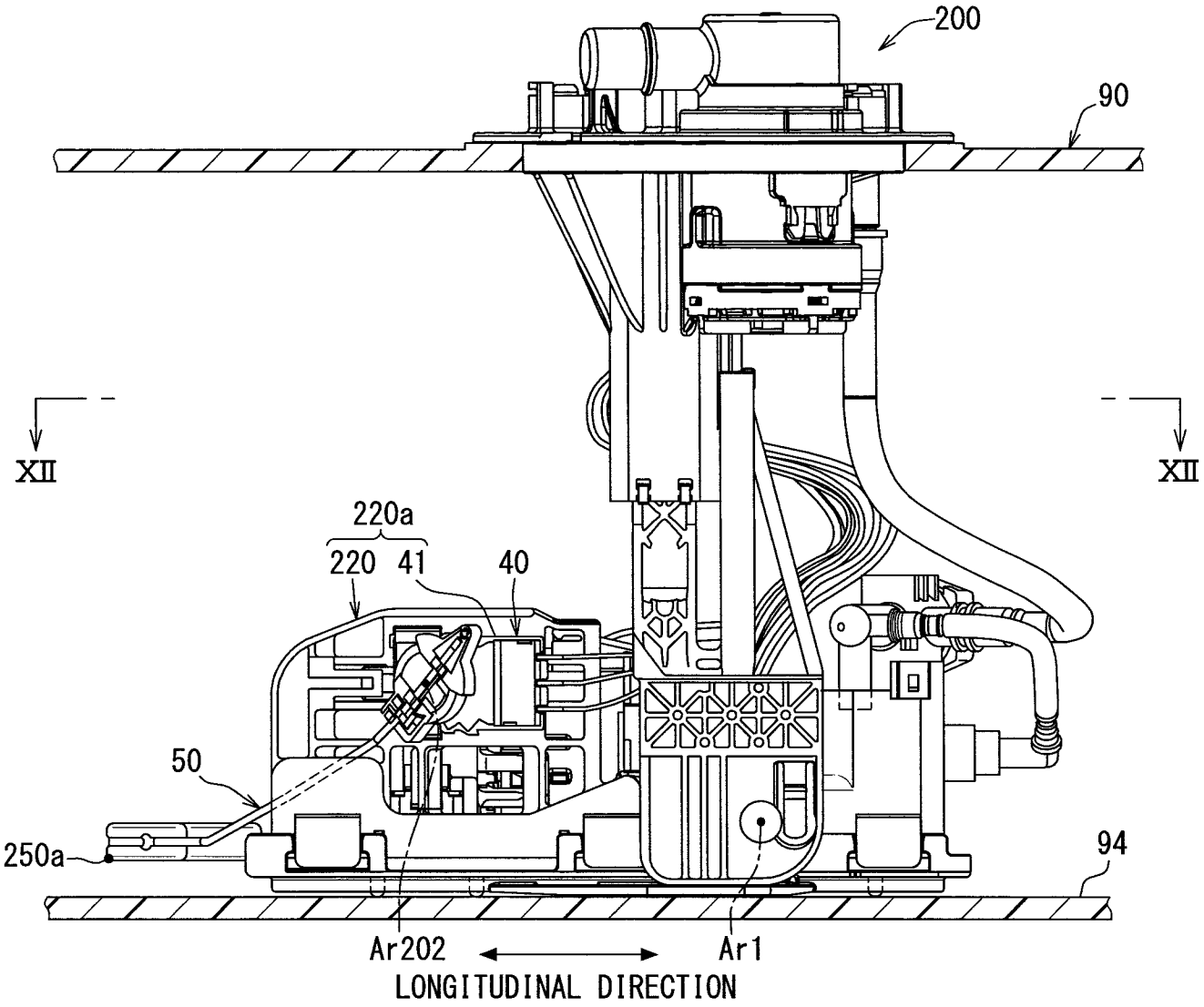
FIG. 11 is a diagram showing a state where a fuel supply device of a second embodiment is placed in the fuel tank.
Figure 12:
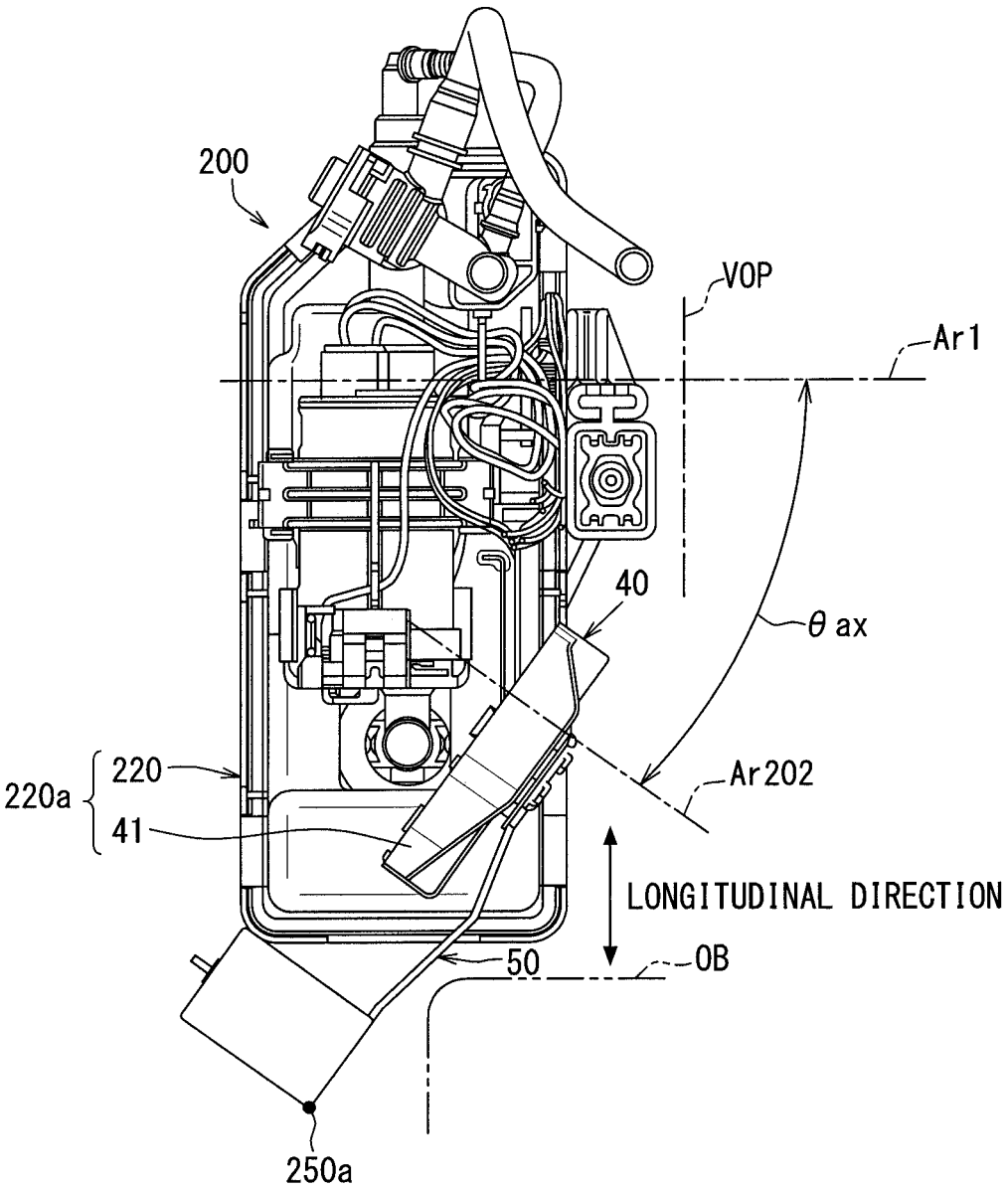
FIG. 12 is a cross-sectional view taken along line XII-XII in FIG. 11.

A fuel supply device 200 of a second embodiment of the present disclosure, which is shown in FIGS. 11 and 12, is a modification of the first embodiment. The second embodiment differs from the first embodiment with respect to an attachment orientation of the surface level detection device 40 relative to the sub-tank 220. The surface level detection device 40 is fixed to the sub-tank 220 in the following manner. That is, the surface level detection device 40 is oriented such that the imaginary rotational center axis Ar202 is tilted relative to the main body rotational axis Ar1. With the above attachment orientation of the surface level detection device 40, the rotational range of the surface level detection unit 50 can be set in a manner that avoids an obstacle OB that is present in the inside of the fuel tank 90.

Specifically, the imaginary rotational center axis Ar202 of the second embodiment is oriented such that the imaginary rotational center axis Ar202 extends along the bottom wall surface 94 like the main body rotational axis Ar1. When the imaginary rotational center axis Ar202 and the main body rotational axis Ar1 are projected onto a common imaginary horizontal plane in the up-and-down direction (see FIG. 12), the imaginary rotational center axis Ar202 is tilted relative to the main body rotational axis Ar1 in this imaginary horizontal plane. When an angle, which is defined between the imaginary rotational center axis Ar202 and the main body rotational axis Ar1 in the imaginary horizontal plane, is referred to as a tilt angle θax, this tilt angle θax of the second embodiment is set to, for example, about 35 degrees.

The imaginary rotational center axis Ar202 of the second embodiment discussed above is set to orient such that the imaginary rotational center axis Ar202 intersects the imaginary perpendicular plane VOP that is perpendicular to the main body rotational axis Ar1, so that the imaginary rotational center axis Ar202 is not parallel with the perpendicular plane VOP. Therefore, even if the longitudinal direction of the supply main body 220*a* is set to coincide with the up-and-down direction at the time of inserting operation, the imaginary rotational center axis Ar202 does not become vertical. Accordingly, the surface level detection unit 50 can be rotated relative to the supply main body 220*a* at the start time of the inserting operation such that the distal end part 250*a* is positioned on the upper side of the imaginary rotational center axis Ar202. Thus, even in the fuel supply device 200 of the second embodiment, the damage of the surface level detection device 40 is avoided. In the second embodiment, among the corners formed at the float 60, the furthermost corner, which is furthermost from the imaginary rotational center axis Ar202 and is furthermost from the supply main body 20*a*, serves as the distal end part 250*a*.

Other Embodiments

Although the embodiments have been described above, the present disclosure should not be limited to the above embodiments and may be applied to various other embodiments and various combinations of the embodiments within the scope of the present disclosure.

The sender arm 55 of the above embodiments is shaped such that the intermediate portion of the sender arm 55 is bent toward the lower side in the rotational direction. Furthermore, the float 60 of the above embodiments is shaped into the flat rectangular parallelepiped form. However, the shape of the sender arm and the shape of the float may be changed to any other appropriate form as long as the distal end part can be placed on the upper side of the imaginary plane VP that includes the imaginary rotational center axis and the center of gravity.

Figure 13:
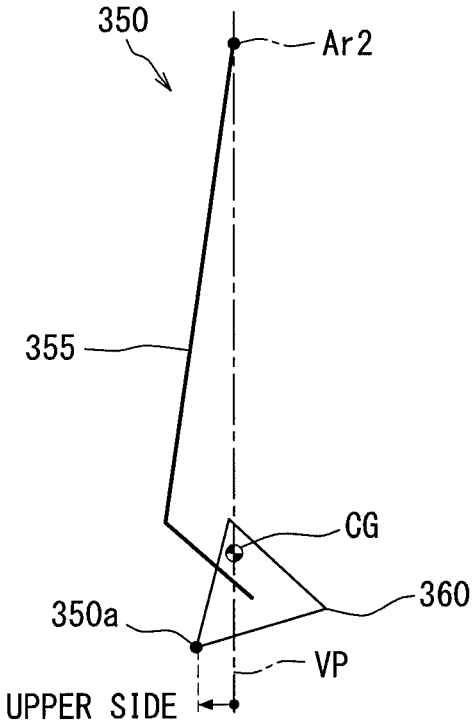
FIG. 13 is a diagram schematically showing a structure of a surface level detection unit in a first modification.

For example, a surface level detection unit 350 of a first modification shown in FIG. 13 includes a sender arm 355 and a float 360, which are shaped differently from those of the first embodiment. An intermediate portion of the sender arm 355 is curved or bent toward the upper side of the surface level detection unit 350 in the rotational direction. The float 360 is shaped into a triangular form and is attached to the sender arm 355 such that an axial direction of the float 360 extends along the imaginary rotational center axis Ar2. Among three sides of the float 360, which extend along the imaginary rotational center axis Ar2, the furthermost side, which is furthermost from the imaginary rotational center axis Ar2, serves as a distal end part 350*a* of the surface level detection unit 350. The distal end part 350*a* is placed on the upper side of the imaginary plane VP, which includes the imaginary rotational center axis Ar2 and the center of gravity CG. Therefore, even in the first modification, a damage of the surface level detection unit 350, which is caused by interference with the bottom wall surface 94 (see FIG. 4) at the time of inserting operation, is limited.

Figure 14:
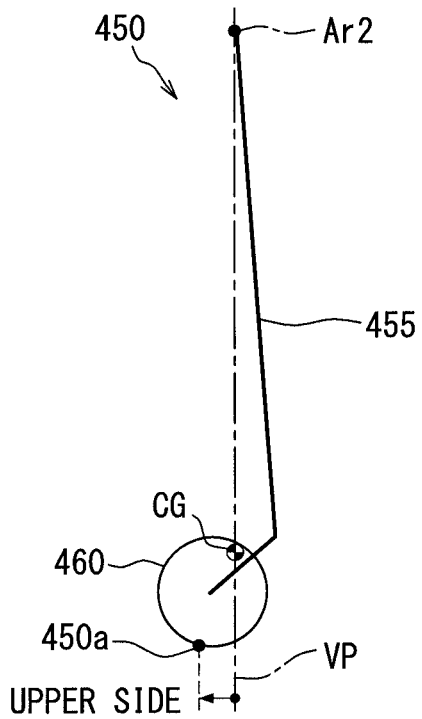
FIG. 14 is a diagram schematically showing a structure of a surface level detection unit in a second modification.

Furthermore, a surface level detection unit 450 of a second modification shown in FIG. 14 includes a sender arm 455 and a float 460, which are shaped differently from those of the first embodiment. An intermediate portion of the sender arm 455 is curved or bent toward the lower side of the surface level detection unit 450 in the rotational direction. The float 460 is shaped into a cylindrical form and is attached to the sender arm 455 such that an axial direction of the float 460 extends along the imaginary rotational center axis Ar2. A furthermost band-shaped region of a cylindrical outer peripheral surface of the float 460, which is furthermost from the imaginary rotational center axis Ar2, serves as a distal end part 450*a* of the surface level detection unit 450. The distal end part 450*a* is placed on the upper side of the imaginary plane VP, which includes the imaginary rotational center axis Ar2 and the center of gravity CG. Therefore, even in the second modification, a damage of the surface level detection unit 450, which is caused by interference with the bottom wall surface 94 (see FIG. 4) at the time of inserting operation, is limited.

Furthermore, any other component of the surface level detection unit, which is other than the float, may form the distal end part of the surface level detection unit. Also, in the case where the float forms the distal end part of the surface level detection unit, a surface roughness of the outer surface of the float is desirably set to a value that enables smooth slide movement of the float along the bottom wall surface without causing sticking of the outer surface of the float to the bottom wall surface. Additionally, the shape of the distal end part may be any form selected from a surface, a line and a dot. In addition, a plurality of parts, which are furthermost from the imaginary rotational center axis, may be defined as distal end parts. In these cases, all of the above-described distal end parts should be placed on the upper side of the imaginary plane.

In the case where the imaginary rotational center axis Ar202 is tilted relative to the main body rotational axis Ar1 like in the second embodiment (see FIG. 12), the tilt angle θax, which is seen from the upper side, may be appropriately changed. Specifically, the tilt angle may be appropriately changed in a range of 0 degrees≤θax<90 degrees. As long as the tilt angle is within this angular range, the surface level detection unit can be rotated by the action of the gravitational force relative to the supply main body at the time of inserting operation.

Furthermore, the imaginary rotational center axis Ar202 of the second embodiment is set to extend in the horizontal direction. Alternatively, the imaginary rotational center axis may be set such that the imaginary rotational center axis is tilted relative to the bottom wall surface or the horizontal plane. As discussed above, as long as the imaginary rotational center axis is set such that the imaginary rotational center axis intersects the perpendicular plane VOP, it is possible to implement the advantage of avoiding the damage and deformation by rotating the surface level detection unit toward the upper side.

Furthermore, even if the attachment orientation of the surface level detection device relative to the sub-tank is set in any manner, the upper side and the lower side in the rotational direction of the surface level detection unit are defined with reference to the supply main body that is in the installed state. Specifically, the surface level detection unit, which is in the installed state, is rotated toward the upper side by the rise of the surface level of the fuel and is rotated toward the lower side by the drop of the surface level of the fuel regardless of the orientation of the imaginary rotational center axis.

The upper limit stoppers and the lower limit stoppers of the above embodiments are provided at the sender body among the sub-tank and the sender body, which form the supply main body. Alternatively, at least one of the upper limit stopper and the lower limit stopper may be formed by a member or a portion that is provided to the sub-tank rather than the sender body such that the at least one of the upper limit stopper and the lower limit stopper projects along a rotational path of the surface level detection unit.

The main body rotational axis Ar1 and the imaginary rotational center axis Ar2 of the above embodiments are located on the opposite sides, respectively, of the longitudinal center of the supply main body. Alternatively, the main body rotational axis Ar1 and the imaginary rotational center axis Ar2 may be placed on a common side of the longitudinal center of the supply main body.

The surface level detection device 40 (see FIG. 3) of the above embodiments has the sensing structure that senses the rotational phase of the surface level detection unit through use of the Hall IC and the magnets. However, the sensing structure of the surface level detection device may be appropriately changed. For example, the fuel supply device may have a surface level detection device that has a sensing structure, in which a variable resistor and a slide plate are displaced relative to each other so that a rotational phase of the surface level detection unit is outputted as a resistance value.

The fuel supply device of the above embodiments are configured such that the supply main body is rotated about the main body rotational axis relative to the flange and the support stay in the inside of the fuel tank. Alternatively, the supply main body may be configured such that the supply main body is only slidable relative to the flange and the support stay and is not rotatable relative to the flange and the support stay.

The imaginary rotational center axis of the above embodiments is set on the upper side of the main body rotational axis. Alternatively, the position of the main body rotational axis and the position of the imaginary rotational center axis may coincide with each other in the up-and-down direction at the supply main body. Further alternatively, the main body rotational axis may be placed on the upper side of the imaginary rotational center axis.

The invention claimed is:

1. A fuel supply device comprising:

a supply main body, which is configured to be inserted through an insertion opening of a fuel tank while the supply main body is oriented such that a specific inserting direction of the supply main body is directed toward the insertion opening;

a surface level detection device that is configured to detect a level of a surface of fuel through use of a float, which is configured to float on the fuel, wherein:

the supply main body includes a lower limit stopper, which limits displacement of the float toward a lower side, wherein the supply main body is configured to be placed in an inside of the fuel tank and supply the fuel to an outside of the fuel tank;

the surface level detection device includes a surface level detection unit that includes the float and is rotatable relative to the supply main body;

rotation of the surface level detection unit toward the lower side is limited through contact of the surface level detection unit to the lower limit stopper; and a rotational range of the surface level detection unit is defined to include at least a space located on a side of the supply main body in the inserting direction; and a support stay that supports the supply main body in a manner that enables rotation of the supply main body about an imaginary main body rotational axis that serves as a rotational center of the supply main body, wherein:

the supply main body is held in an installation orientation of the supply main body, when the supply main body is installed in an installed state in the inside of the fuel tank;

the supply main body is in an insertion orientation when the supply main body is being inserted through the insertion opening;

the supply main body is rotated toward an upper side relative to the support stay when the supply main body is moved to the installation orientation from the insertion orientation;

in the insertion orientation, the surface level detection unit is rotatable relative to the supply main body;

in a state where the supply main body is placed in the insertion orientation, at which an imaginary rotational center axis of the surface level detection unit and a center of gravity of the surface level detection unit are placed along an imaginary plane that extends in a gravitational direction, a distal end part of the surface level detection unit, which is furthermost from the imaginary rotational center axis of the surface level detection unit, is located on one side of the imaginary plane, which is opposite to a bottom of the supply main body in a direction that is perpendicular to the imaginary plane;

the bottom of the supply main body is configured to contact a bottom wall surface of the fuel tank when the supply main body is held in the installation orientation, and the imaginary main body rotational axis is located on another side of the imaginary plane which is opposite to the one side in the direction that is perpendicular to the imaginary plane;

the distal end part is configured to contact the bottom wall surface and slide along the bottom wall surface toward the upper side as the supply main body is moved from the insertion orientation to the installation orientation;

the surface level detection unit includes a sender arm that is formed in one-piece and is in a form of rod;

the sender arm is configured to rotate about the imaginary rotation center axis;

the float is coupled to a distal end part of the sender arm; and the center of gravity is located at the float.

2. The fuel supply device according to claim 1, wherein the imaginary rotational center axis of the surface level detection unit is located on the upper side of the main body rotational axis of the supply main body.

3. The fuel supply device according to claim 1, wherein the imaginary rotational center axis of the surface level detection unit is set to orient such that the imaginary rotational center axis intersects an imaginary perpendicular plane that is perpendicular to the main body rotational axis.

4. The fuel supply device according to claim 1, wherein the imaginary rotational center axis of the surface level detection unit is set to orient such that the imaginary rotational center axis extends parallel to the main body rotational axis of the supply main body.

5. The fuel supply device according to claim 1, wherein in the state where the supply main body is placed in the insertion orientation, the lower limit stopper is located on the upper side of the imaginary rotational center axis of the surface level detection unit in an up-and-down direction in parallel with the gravitational direction.

6. The fuel supply device according to claim 1, wherein in the state where the supply main body is placed in the insertion orientation, the surface level detection unit is spaced away from the lower limit stopper of the surface level detection unit.

* * * * *